United States Patent [19]

Ono

[11] 4,209,110

[45] Jun. 24, 1980

[54] VENDING MACHINE FOR ARTICLES CONNECTED TO AN ELONGATED MEMBER

[76] Inventor: Nobuyasu Ono, 19-3, Tokiwadaira 4-chome, Matsudo-shi, Chiba-ken, Japan

[21] Appl. No.: 930,026

[22] Filed: Aug. 1, 1978

Related U.S. Application Data

[63] Continuation-in-part of Ser. No. 722,769, Sep. 13, 1976, abandoned.

[30] Foreign Application Priority Data

| | | | |
|---|---|---|---|
| Sep. 14, 1976 | [DE] | Fed. Rep. of Germany | 2641306 |
| Sep. 13, 1976 | [FR] | France | 76 27516 |
| Sep. 14, 1975 | [JP] | Japan | 50-111563 |
| Sep. 14, 1975 | [JP] | Japan | 50-111564 |
| Jan. 29, 1976 | [JP] | Japan | 51-9060 |
| Aug. 14, 1976 | [JP] | Japan | 51-97165 |
| Aug. 14, 1976 | [JP] | Japan | 51-97166 |

[51] Int. Cl.[2] ..... G07F 11/68

[52] U.S. Cl. ..... 221/73; 221/150 R; 221/192

[58] Field of Search ..... 221/26, 70–74, 221/79–81, 89, 150 R, 150 B, 312 A, 199, 25, 27, 247–249, 192; 242/147 R, 75.3; 225/106; 226/152, 157, 195, 188; 198/624; 271/272–274, 183, 188; 62/378

[56] References Cited

U.S. PATENT DOCUMENTS

| | | | |
|---|---|---|---|
| 1,929,087 | 10/1933 | Wood | 242/75.3 |
| 2,186,302 | 1/1940 | Martin | 221/72 X |
| 3,001,669 | 9/1961 | Tandler et al. | 221/247 X |
| 3,134,502 | 5/1964 | Kusznier | 221/74 |
| 3,196,656 | 7/1965 | Johnston | 226/184 X |
| 3,298,567 | 1/1967 | Hahn | 221/74 |
| 3,540,642 | 11/1970 | Riegel | 226/195 X |
| 3,563,174 | 2/1971 | Anderson et al. | 226/195 X |
| 3,749,398 | 7/1973 | Fujita et al. | 271/188 X |
| 3,817,422 | 6/1974 | Raitt | 221/74 |
| 3,904,145 | 9/1975 | Steinberger et al. | 226/195 X |
| 3,966,198 | 6/1976 | Komada et al. | 271/272 X |

*Primary Examiner*—Robert J. Spar
*Assistant Examiner*—Fred A. Silverberg
*Attorney, Agent, or Firm*—Shapiro and Shapiro

[57] ABSTRACT

In a vending machine using an elongated member to which a plurality of articles to be sold are connected at predetermined intervals, there are provided a draw-up mechanism for drawing up the elongated member and a gate formed with an opening smaller in size than each of the articles. The gate may pass the elongated member into the draw-up mechanism through the opening and block passage of the leading one of the articles to detach it from the elongated member as it is drawn up by the draw-up mechanism.

45 Claims, 21 Drawing Figures

VENDING MACHINE FOR ARTICLES CONNECTED TO AN ELONGATED MEMBER

CROSS-REFERENCES TO RELATED APPLICATIONS

This is a continuation-in-part of copending application Ser. No. 722,769 filed Sept. 13, 1976 for VENDING MACHINE FOR ARTICLES CONNECTED TO AN ELONGATED MEMBER, now abandoned.

BACKGROUND OF THE INVENTION

1. Field of the Invention

This invention relates to a vending machine from which articles connected to an elongated member such as tape or the like at suitable intervals may be drawn out for sale.

2. Description of the Prior Art

In a vending machine in which a number of articles connected to yarn, tape or like elongated member (hereinafter referred to as yarn) may be automatically drawn out for sale, it is difficult to control the detachment of the articles from the yarn and to control the draw-out or draw-back of the yarn.

Furthermore, in such a machine vending ice cream or similar articles which must be maintained at a temperature of the order of −20° C., the mechanical or the electrical portion of the machine tends to freeze, rendering the machine inoperable.

SUMMARY OF THE INVENTION

It is therefore an object of the present invention to provide a vending machine in which the mechanical or the electrical portion is distinctly isolated from the article storage chamber (namely, the refrigerating chamber).

In such a vending machine, articles to be sold may be pre-connected to a length of yarn so that they may be sold by each of the articles being drawn out and detached from the yarn during vending.

It is further an object of the present invention to make it possible in the vending machine of the described type that articles to be sold be readily detached from the yarn to which the articles are connected.

It is another object of the present invention to provide, in the vending machine of such type, a tension switch mechanism utilizing the tension of the yarn to enable the articles to be reliably drawn out for sale.

It is still another object of the present invention to provide a tension switch mechanism which may reliably perform the display of sellout.

It is yet still another object of the present invention to provide a tension mechanism which may enable the articles for sale to be reliably held in the storage chamber by reversely rotating yarn draw-up means.

It is a further object of the present invention to provide yarn draw-up means which is capable of drawing up the articles connected to the yarn with a uniform force.

However, the yarn having left the yarn draw-up means may involve the risk of following the movement of the yarn draw-up means to be thereby entangled in the yarn draw-up means.

It is also an object of the present invention to provide a mechanism for preventing such entanglement of the yarn in the yarn draw-up means.

It is a further object of the present invention to provide a vending machine which can detect and indicate that the articles have been sold out.

To achieve these objects, the vending machine of the present invention may comprise an elongated member to which a plurality of articles to be sold are connected at predetermined intervals, means for drawing up the elongated member, and gate means having therein an opening smaller in size than each of the articles, the gate means being effective to pass the elongated member into the draw-up means through the opening and to block passage of the leading one of the articles to detach said one article from the elongated member as it is drawn up by the draw-up means.

The invention will become more fully apparent from the following detailed description of some embodiments thereof taken in conjunction with the accompanying drawings.

DESCRIPTION OF THE PREFERRED EMBODIMENTS

Figure 1A:
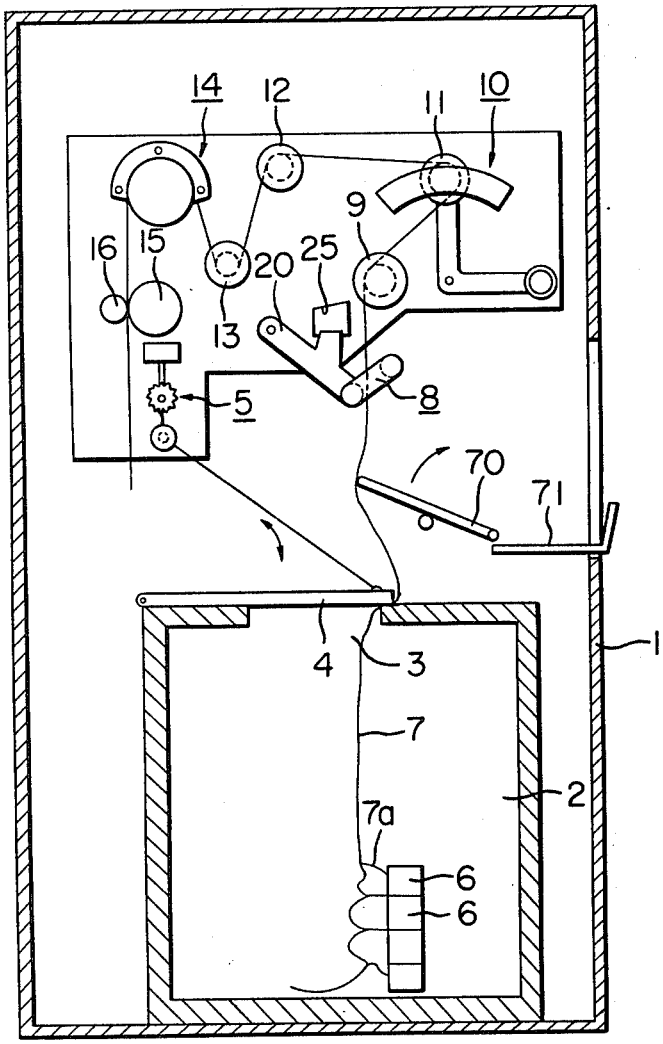
FIG. 1A is a schematic vertical section view of an embodiment of the present invention.

FIG. 1A schematically shows the vending machine according to a first embodiment of the present invention. In FIG. 1, reference character 1 designates the main housing of the vending machine which is shown in vertical cross-section. In the lower portion of the main housing, there is provided an article storage chamber 2. The storage chamber 2 may be formed as an electric refrigerating chamber if the article to be sold is ice cream or like material which must be maintained cold. The side walls of the refrigerating chamber are preferably separated or distant from the side walls of the body of the vending machine by a certain distance so that heat caused by direct rays of the Sun may be prevented from transmitted from the latter walls to the refrigerating chamber.

The refrigerating chamber has an article outlet opening 3 formed in the upper wall thereof. A cover or lid 4 is formed over the opening 3. The lid 4 is normally closed and designed to be automatically opened and closed by a driving means 5 in response to the vending of the articles 6.

The articles to be sold 6 are arranged at suitable intervals and connected to a length of yarn 7 by means of suitable connector members 7*a* and accommodated in the storage chamber 2. Each of the articles 6 may be wrapped in a small bag of polyethylene or like material which may directly be fused to the yarn 7. Placement of the articles 6 into the storage chamber 2 may be done by opening an unshown door provided in the main housing 1. Alternatively, the articles may be preset in boxes or the like and these boxes may be placed in the storage chamber and interchanged when required.

The yarn 7 extends upwardly through the opening 3 and over a gate 8 for detaching the articles 6, a guide wheel 9, a pulley 11 of a balancing mechanism 10, guide wheels 12, 13 and thence leads to yarn draw-up means 14. The yarn further extends downwardly from the yarn draw-up means 14 to pass between guide wheels 15 and 16 for preventing coiling of the yarn. All of these means 8 to 16 are provided on the front surface 17*a* (FIG. 2) of a support plate 17 secured to the main housing of the vending machine. Having left the guide wheels 15 and 16, the yarn lowers from gravity and may be preserved in a suitable discharge box, not shown.

Reference will now be had to FIGS. 1B to 1D and FIGS. 2 to 9 to describe the first embodiment of the present invention more specifically.

Figure 1B:
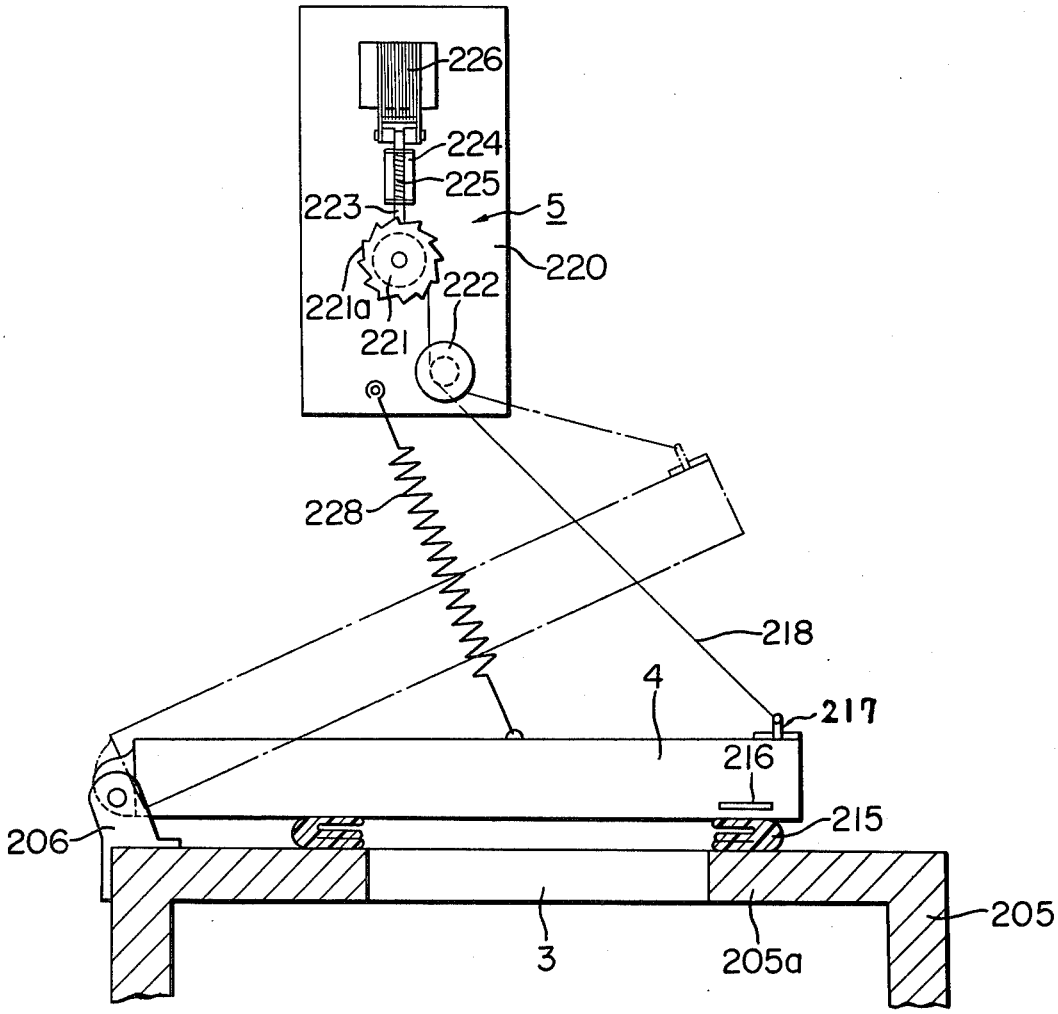
FIG. 1B is an enlarged lid driving mechanism portion of the embodiment in FIG. 1.
Figure 1C:
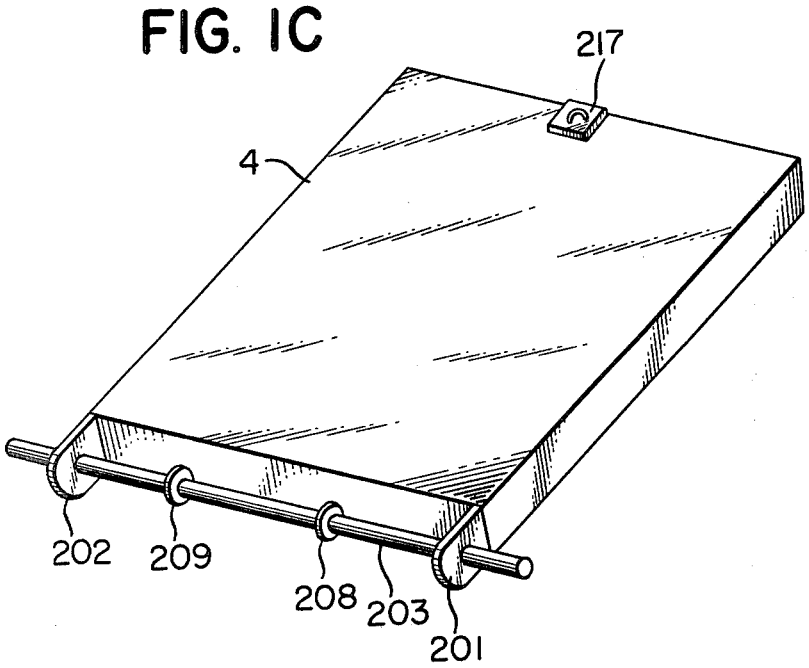
FIG. 1C is a perspective view of the lid of the refrigerating chamber.
Figure 1D:
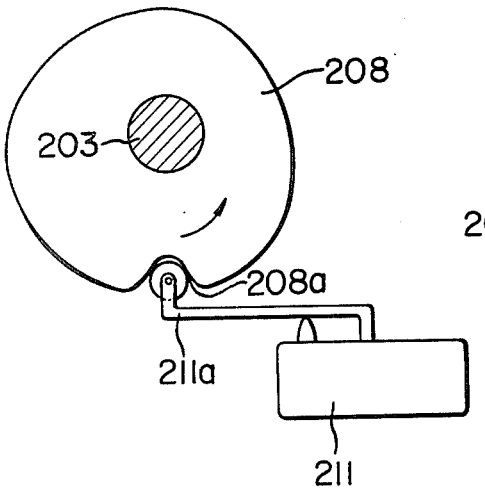
FIGS. 1D and 1E are the enlarged views of cam plate members attached to the shaft of the lid of the refrigerating chamber.
Figure 1E:
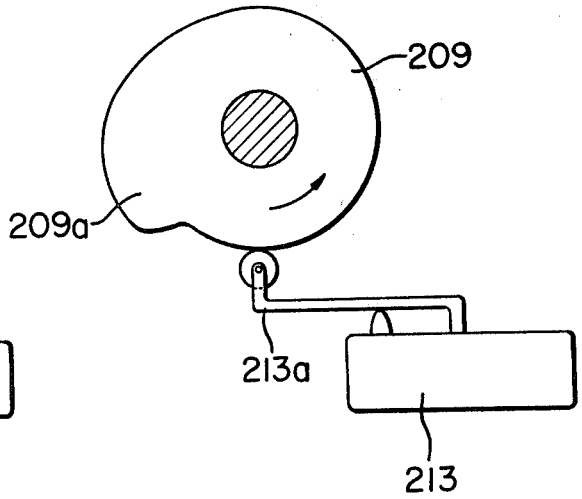

Referring to FIGS. 1B and 1C, the lid 4 is integrally formed at its rear side ends with projected plates 201 and 202, to which an elongated bar or shaft 203 is fixed. The bar 203 has portions extended from the projections 201 and 202 and is rotatably supported at these portions to two support members 206 (only one is shown in FIG. 1B) fixed to the rear side ends of a box 205 forming the refrigerating chamber 2. To the bar 203 are attached two cam plate members 208 and 209 which rotate in unison with the rotation of the bar 203 due to the opening-closing rotative movement of the lid 4. The cam plate 208 has a cam portion 208*a* (as shown in FIG. 1D) which is in contact with a contact piece 211*a* of a normally opened micro switch 211 secured to the box 205. The micro switch 211 is opened when the lid 4 is in a closed position shown by the full line in FIG. 1B, and is closed when the lid 4 is opened. The cam plate 209 is in contact with the contact piece 213*a* of a micro switch 213 secured to the box 205. The cam portion 209*a* of the cam plate 209 changes over the micro switch 213 when the lid 4 is brought in its fully opened position shown in a dotted line in FIG. 1B.

A seal 215 made of elastic material such as rubber is secured onto the peripheral portion 205*a* of the opening 4, that is, onto the upper wall of the box 205 to surround the opening 3. The seal 215 is in tight or pressed contact with the lid 4 when the latter is closed, so that cooled air in the refrigerating chamber is prevented from leaking out through the opening 3. The seal 215 is preferably magnetized and the lid 4 is provided with a piece of magnetic material 216 such as iron in correspondence with the magnetized portion of the seal, so that the lid 4 can close the opening 3 more tightly.

A hook or suitable member 217 for connecting an end of a wire 218 is secured to the forward central portion of the lid 4. The other end of the wire 218 is connected through a guide pulley 222 to a reel 221 of a lid driving means 5 mounted on a support plate 220 secured to the main housing of the vending machine. The support plate 220 may be formed as a portion of the aforementioned support plate 17, as shown in FIG. 1B. The wire 218, when taken up by the reel 221, raises the lid 4 into the open position. The driving reel 221 is directly driven by a motor Ms (FIG. 11) mounted on the reverse side of the support plate 220. The reel 221 is provided integrally and coaxially with a ratchet wheel 221*a*, which is directed to prevent the reverse rotation of the driving reel 221 so that the lid 4 may not close the opening 3 during vending. For this purpose, above the reel 221 a lock bar 223 is provided which is engageable with the ratchet wheel 221*a*. The lock bar 223 is slidable vertically on a support member 224 secured to the support plate 220 and is normally biased downward by a coil spring 225 to engage the ratchet wheet 221*a*. The support plate 220 is provided with a solenoid 226 for controlling the lock bar 223. When the lid 4 is in the closed position, the solenoid 226 is nonconductive so that the lock bar 223 is in its lowered position. When the lid 4 begins to open, the solenoid is energized so that the lock bar is raised up and disengaged from the ratchet wheel 221*a*. The solenoid 226 is deenergized when the lid 4 is fully opened, so that the lock bar 223 is lowered by the spring 225 and its own gravity and engages the ratchet wheel 221*a* to prevent the reverse rotation of the reel 221 during vending operation. When vending is completed and it becomes unnecessary to hold the lid 4 open, the solenoid 226 is again energized to attract up the lock bar 223 so that the lid 4 is brought into the closed position by its own gravity. It is preferable to provide a tension coil spring 228 between the lid 4 and the support plate 220 to damp the downward movement of the lid 4. The reason why the lock bar 223 is disengaged from the ratchet wheel 221*a* during the opening movement of the lid 4 is for preventing undesirable noise which otherwise is caused.

The gate 8 (FIG. 5) is of a ring-shape having a central bore 8*a* which is smaller in size than an article 6 to prevent the article 6 from passing therethrough, and the gate is supported by a support member 20 integrally formed therewith. The cross-section of the gate 8 should desirably be of a curved shape, particularly of a curved shape having a uniform curvature at least in the lower portion thereof which is contacted by the article (namely, part of a circle). The support member 20 is pivotally supported on the support plate 17 by means of a pin 21 and biased clockwise by a spring 22. An upwardly extending branch 23 is formed in the center portion of the gate support member 20, and the end of the branch has a turned-back portion 24. The turned-back portion 24 extends through a substantially sector-shaped window 25 formed in the support plate 17 and is projected beyond the back surface of the support plate 17. Since the support member 20 is clockwisely biased by the spring 22, the turned-back portion 24 engages the lower edge 25*a* of the sector window 25 to hold the gate 8 in the shown position when the vending machine is not in operation.

On the back surface of the support plate (FIG. 3), a first switch 26 is securely mounted adjacent to the lower edge 25a of the sector window 25. The contact 26a of the first switch 26 is engageable with the turned-back portion 24 of the gate support member 20 and when the gate support member 20 is in its lowered position as shown, the turned-back portion 24 brings the first switch into its closed position. A second switch 27 is also securely mounted on the back surface of the support plate 17 adjacent to the upper edge of the sector window 25. The contact 27a of the second switch is engageable with the turned-back portion 24 to change over the second switch 27 when the support member 20 is rotated counterclockwise as viewed in FIG. 2 so that the turned-back portion 24 approaches the upper edge 25b of the window 25.

As already noted, the yarn 7 passed through the central bore 8a of the gate 8 extends over the guide wheel 9 rotatably mounted on the front surface 17a of the support plate 17 and is twined around the pulley 11 of the balancing mechanism 10 to thereby impart a tension to the pulley 11. The pulley 11 is rotatably mounted on the end of one branch member 28a of balancing means 28. The balancing means 28 is pivotally mounted at its base portion on the support plate 17 by means of a shaft 29, and has a second branch member 30 extending rightwardly and substantially perpendicularly to said one branch member 28a, as viewed in FIG. 2. The end of the second branch member 30 has a cylinderical weight 30a pivotally supported thereto so that the balancing means 28 is biased clockwise by the gravity of the weight 30a. Thus, the balancing means 28 is maintained in a position where the tension of the yarn 7 imparted to the pulley 11 and the gravity of the weight 30a are balanced with each other.

On the other hand, the support plate 17 is formed with a sector window 31 centered at the pivot point 29 of the balancing means 28. The end portion of the first branch member 28a of the balancing means 28 provides a portion 32 (FIG. 4) projected into the sector window 31, and a switch actuating member 33 is securely mounted on such portion. The projected portion 32 lies radially inwardly of the outer periphery of the sector window 31, so that the balancing means 28 is pivotable to the balanced position within the range limited by the sector window, in accordance with the magnitude of the tension of the yarn 7. The switch actuating member 33 is projected beyond the back surface 17b of the support plate 17 and has switch actuating pieces 33a and 33b formed at the opposite ends thereof.

Figure 2:
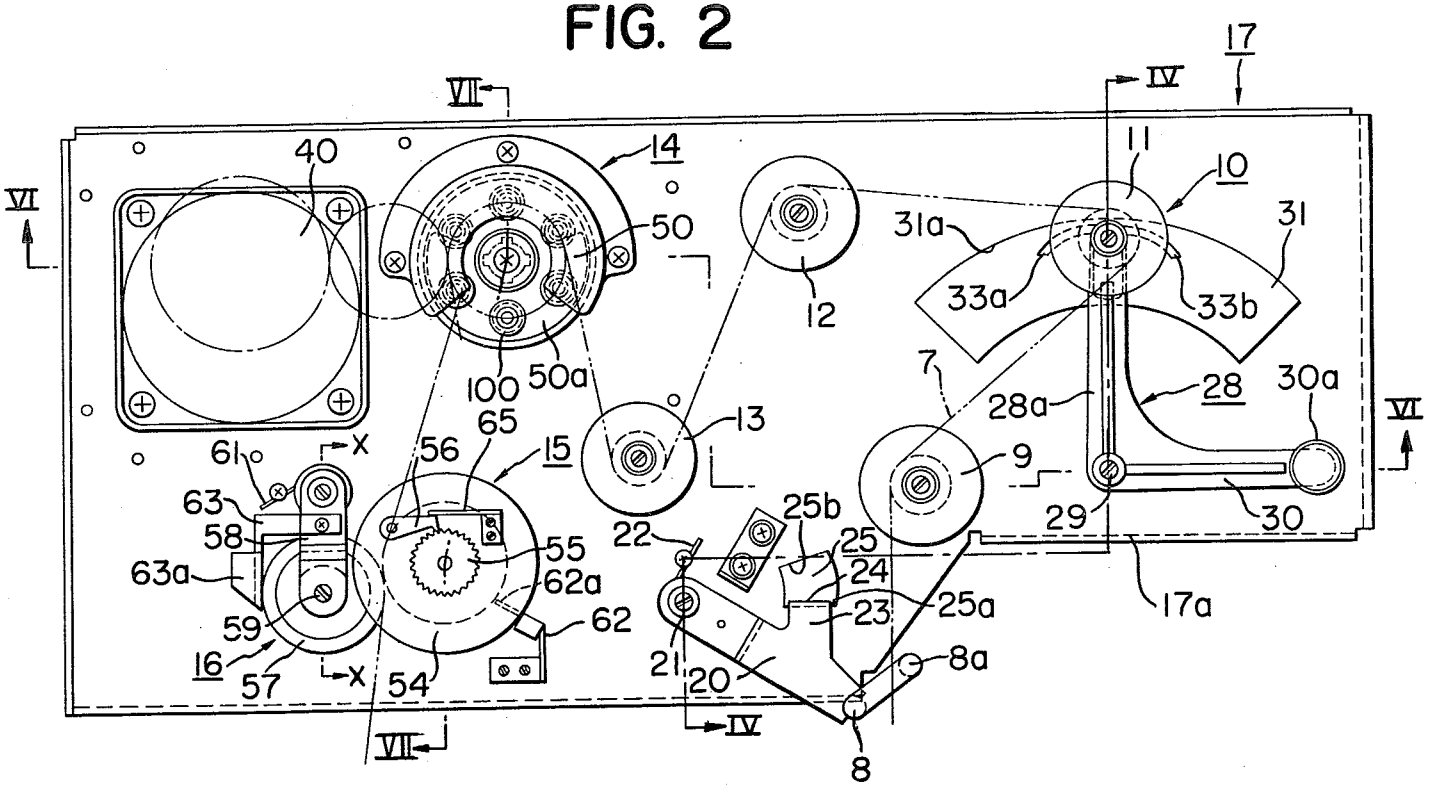
FIG. 2 is a front view of the actuating mechanism portion of a first embodiment of the present invention.
Figure 3:
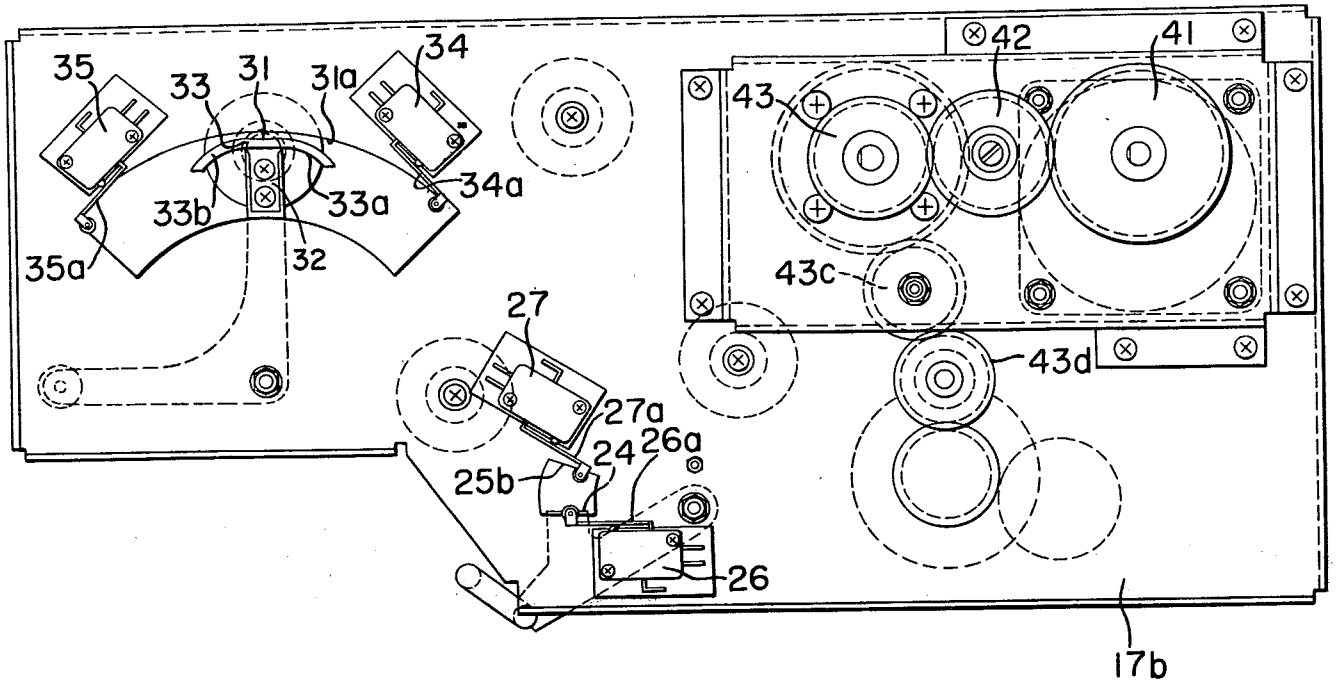
FIG. 3 is a rear view thereof.
Figure 4:
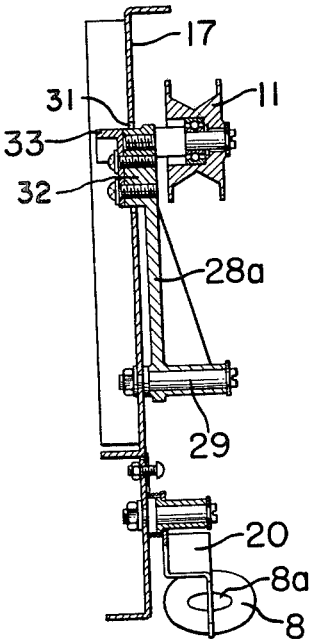
FIG. 4 is a cross-sectional view taken along line IV—IV in FIG. 2.
Figure 5:
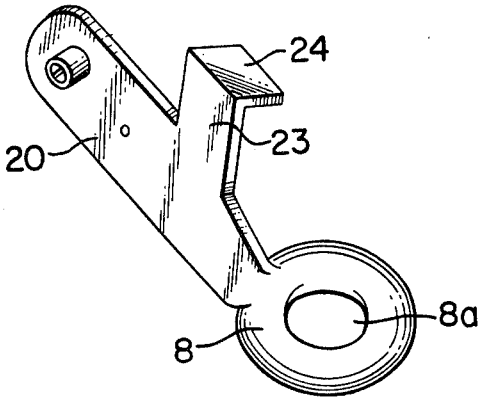
FIG. 5 is an elongated perspective view of the gate.

On the back surface 17b of the support plate 17, a third switch 34 which is a motor reversing switch is securely mounted in the neighborhood of the right end of the sector window 31, as viewed in FIG. 3. The contact 34a of the third switch 34 is projected so as to be engageable with the aforementioned switch actuating piece 33a and, when the balancing means 28 is rotated counter-clockwise as viewed in FIG. 2, the contact 34 may be pushed by the switch actuating piece 33a to close the switch 34. Thus, the tension of the yarn 7 is increased as an article 6 is lifted during vending, so that the balancing means 28 is rotated counter-clockwise in FIG. 2 (clockwise in FIG. 3) against the force of gravity on the weight 30a, as already noted, thereby closing the third switch 34. When the article 6 has been detached from the yarn by the gate 8, the tension of the yarn is somewhat decreased but if a subsequent article is then in suspension, the tension resulting from such subsequent article will maintain the balancing means intactly in its rotated position, thus maintaining the third switch 34 in its closed position. By a circuit arrangement which will hereinafter be described, a reversible motor 40 is reversed to lower the suspended article into non-suspended position and such state continues until the tension of the yarn is restored its initial condition.

On the back surface 17b of the support plate 17, a fourth switch 35 which is a sellout display switch is securely mounted in the neighborhood of the left end of the sector window 31, as viewed in FIG. 3. The contact 35a of this switch is projected so as to be engageable with the switch actuating member 33b. Thus, when all the articles 6 have been sold out and there is no longer any tension acting on the yarn 7 so that the balancing means 28 is rotated clockwise in FIG. 2 (counter-clockwise in FIG. 3) by the force of gravity on the weight 30a, the contact 35a is pushed by the switch actuating piece 33b to close the fourth switch, whereby the sellout may be displayed by a circuit arrangement which will hereinafter be described.

Having left the above-described balancing mechanism 10, the yarn 7 is guided via the two guide wheels 12, 13, rotatably mounted on the front surface 17a of the support plate 17, to the yarn draw-up means 14.

Figure 7:
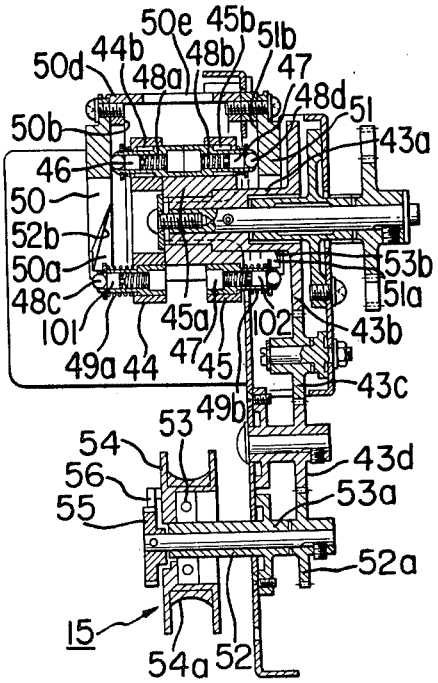
FIG. 7 is a cross-sectional view taken along line VII—VII in FIG. 2.
Figure 6:
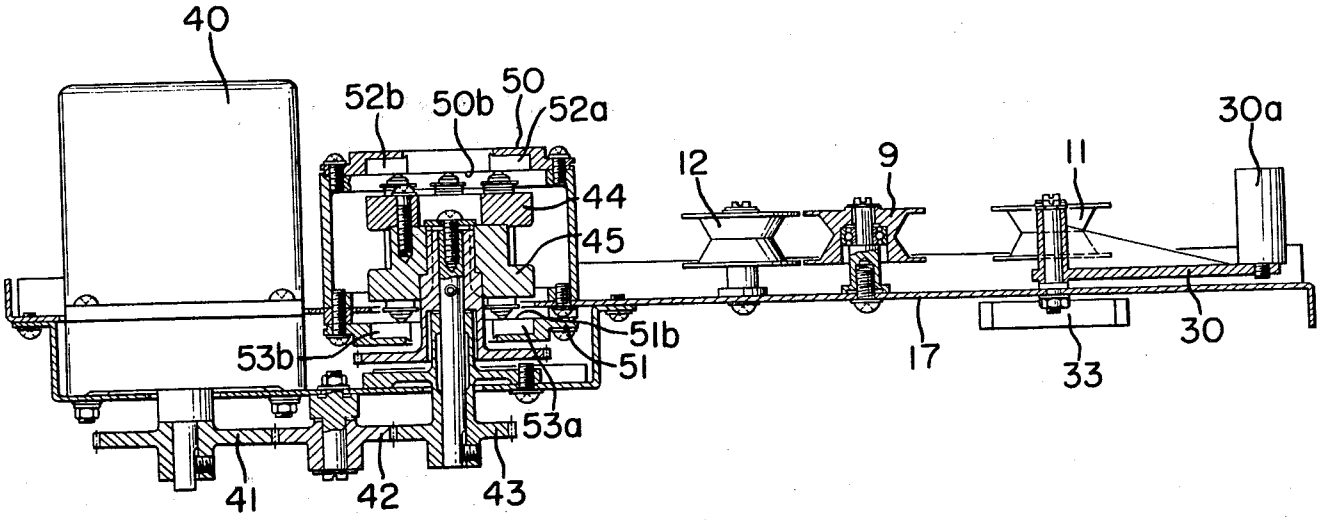
FIG. 6 is a cross-sectional view taken along line VI—VI in FIG. 2.
Figure 8:
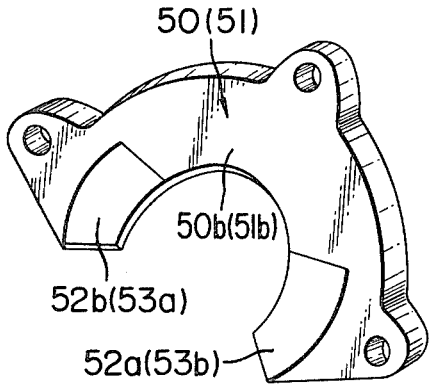
FIG. 8 is an enlarged perspective view of the cam plate of yarn draw-up means.
Figure 9:
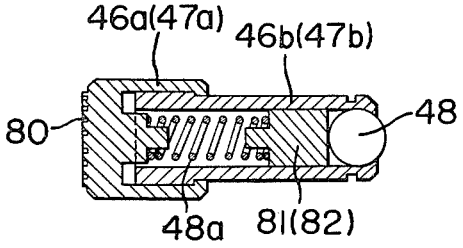
FIG. 9 is a cross-sectional view showing a modified form of the yarn nipping member.

The yarn draw-up means 14 has a pair of opposed discs 44 and 45 rotatably driven about a common shaft by the motor 40 through gear trains 41, 42, 43 (see FIGS. 6 and 7). The discs 44 and 45 are made integral with each other by a tubular portion 45a. The discs respectively have six axially extending bores 44b and 45b formed along a common circumference, the bores 44b being opposed to the bores 45b. Each of the bores 44b and 45b has a larger diameter in the axially inner portion thereof and a smaller diameter in the axially outer portion thereof, and yarn nipping members 46 and 47 are provided in the bores, respectively. The yarn nipping members 46 and 47 have larger-diametered and smaller-diametered portions corresponding to those of the bores, and the opposed surfaces of the larger-diametered portions may preferably be flat so as to permit a number of concentric or spiral grooves 80 (FIG. 9) to be formed therein so that the draw-up force may be increased when the yarn nipping members hold the yarn therebetween. In the inner and outer ends of the yarn nipping members, there are embedded balls 48c and 48d which are outwardly biased by springs 48a and 48b secured to spring receiving sliders 81 and 82, and the yarn nipping members are biased axially outwardly by coil springs 49a, 49b inserted between the yarn nippin members and the discs. FIG. 9 shows a modified form of the yarn nipping members, in which the yarn nipping members comprise yarn nipping portions 46a, 47a and ball support members 46b, 47b fitted and relatively slidable thereto.

Cam plates 50 and 51 (FIGS. 6–8) are provided outwardly of the discs 44 and 45 and secured to the support plate 17 by means of a semi-tubular portion 50b which is integral with the cam plates. The cam plates 50, 51 each is of a sector-like shape having a sector-shaped cutaway 50a, 51a in the lower portion thereof, and the central flat portion 50b, 51b which is in contact with the yarn nipping members has, at the opposite ends thereof, inclined surfaces 52a, 53a and 52b, 53b enlarged axially outwardly toward the cutaways 50a, 51a. When in the cutaways, the two opposed yarn nipping members are axially spaced apart from each other by the action of the coil spring 49, but as these yarn nipping members are brought into contact with the inclined surfaces 52*a*, 53*a* adjacent the entrances of the cam plates 50, 51 by the rotation of the discs 44, 45, the spacing between the yarn nipping members is decreased until they come into close contact past the inclined surfaces, and when the yarn nipping members reach the inclined surfaces 52*b*, 53*b* at the other end, the spacing therebetween is again increased to space apart the yarn nipping members from each other. The yarn 7 is nipped by these closely adjacent yarn nipping members and guided from right to left in FIG. 2. The yarn is normally held by at least three pairs of yarn nipping members and rotation of the discs 44, 45 causes the yarn to be nipped and paid away by the yarn nipping members, until the yarn is liberated at the outlet portion because of the increased spacing between the pairs of yarn nipping members. If the discs 44, 45 are reversed in direction of rotation by the reversal of the motor, the yarn 7 may likewise be paid away in the opposite direction, namely, in the return direction. If a suitable window 50*e* (FIG. 7) is provided in the semicylindrical portion 50*d*, the setting of the yarn to the yarn draw-up means may be readily accomplished.

When liberated from the yarn draw-up means, the yarn lowers from gravity but may sometimes follow the yarn nipping members 46, 47 and be entangled therein. To avoid such a danger, the present invention provides guide means 15 and 16 below the yarn draw-up means. The guide means 15 has a pulley 54 rotatably mounted about a shaft 52 by means of shaft support member 53*a* and bearing 53. The peripheral guide surface 54*a* of the pulley 54 is formed of a concavely-surfaced elastic material. The shaft 52 if projected beyond the back surface of the support plate 17, and a gear 52*a* is securely mounted on the projected portioh of the shaft. The gear 52*a* may be driven through a gear 43*b* securely mounted on the shaft 43*a* of the discs 44, 45, and through the intermediate gears 43*c* and 43*d*. The gear ratio of these gears is set so that the gear 52*a* and accordingly the shaft 52 rotates at a speed equal to or slightly higher than that of the disc 44, 45. A ratchet wheel 55 is securely mounted on that end portion of the shaft 52 which is projected through the pulley 54. On that side of the pulley which is adjacent to the ratchet wheel 55, a brake 56 is mounted pivotally and in such a manner that the toothed end thereof is engageable with a tooth of the ratchet wheel 55 by the action of a leaf spring 65 (FIG. 2). The ratchet wheel 55 and the brake 56 together constitute a one-way clutch which transmits normal (counterclockwise in FIG. 2) rotation of the ratchet wheel 55 to the pulley 54 but does not transmit reverse rotation of the ratchet wheel 55 to the pulley.

Figure 10:
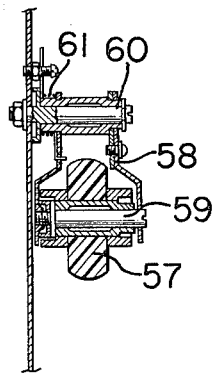
FIG. 10 is a cross-section taken along line X—X in FIG. 2.

The other guide means 16 has a pinch roller 57 formed of an elastic material. The outer peripheral surface of the pinch roller is convexly contoured to fit the peripheral guide surface 54*a* of the pulley 54. The pinch roller 57 is rotatably mounted on a support member 58 by means of a pin 59. The support member 58 has the other end thereof pivotally supported to the support plate 17 by means of a pin 60 (FIG. 10), and a spring 61 is disposed between the pinch roller 57 and the support plate 17 to bias the pinch roller 57 against the guide surface 54*a* of the pulley 54.

Having left the yarn draw-up means 14, the yarn is nipped between the pulley 54 and the pinch roller 57. Thus, during normal rotation of the motor, the pulley 54 is permitted to rotate by the action of the one-way clutch 55, 56 to thereby lower the yarn, thus preventing the yarn having left the yarn draw-up means 14 from being entangled therein. When the motor is rotating in reverse direction in a manner to be described, the pulley 54 is free from reverse rotation of the wheel 55 by the action of the one-way clutch and freely rotatable in the reverse direction. Therefore the pulley and the pinch roller which is also reversely rotatable permit passage of the yarn.

Blocking members 62 and 63 are provided to prevent the yarn 7 from following the pulley or the pinch roller to be entangled therein. The blocking member 62 is secured to the support plate 17 and has a blocking portion 62*a* substantially engaged with the guide surface 54*a* of the pulley 54. The other blocking member 63 is secured to the support member 58 for the pinch roller 57 and has a blocking portion 63*a* substantially engaged with the peripheral surface of the pinch roller 57. The provision of these blocking members 62 and 63 prevents the yarn from being entangled in the pulley 54 or the pinch roller 57 even if it happens to follow them.

Figure 11:
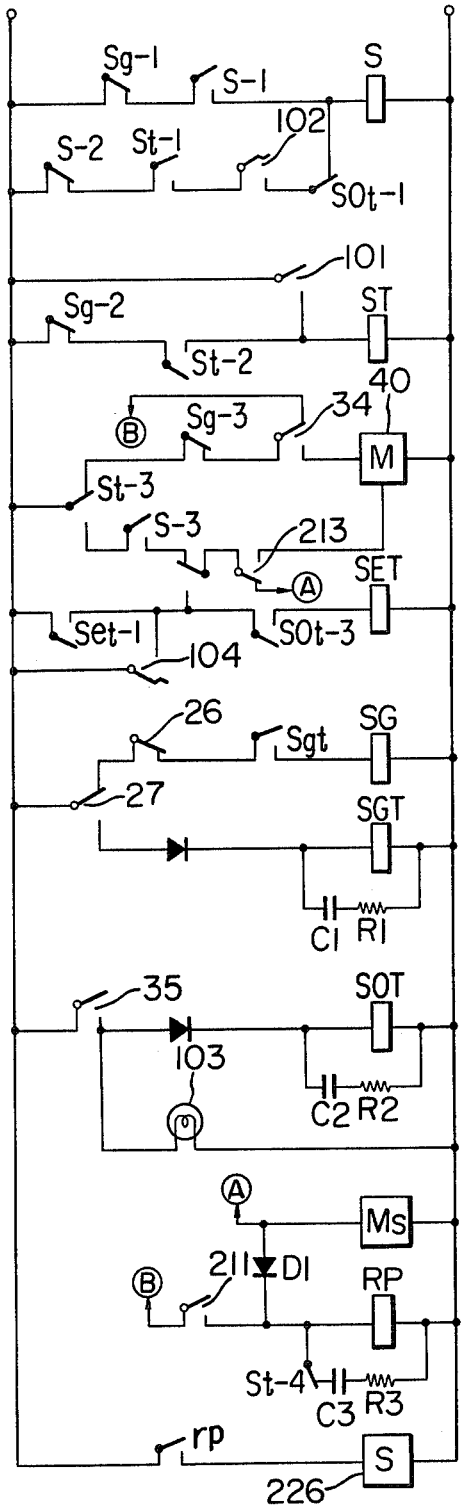
FIG. 11 is a diagram of the electric circuit in the first embodiment.
Figure 12:
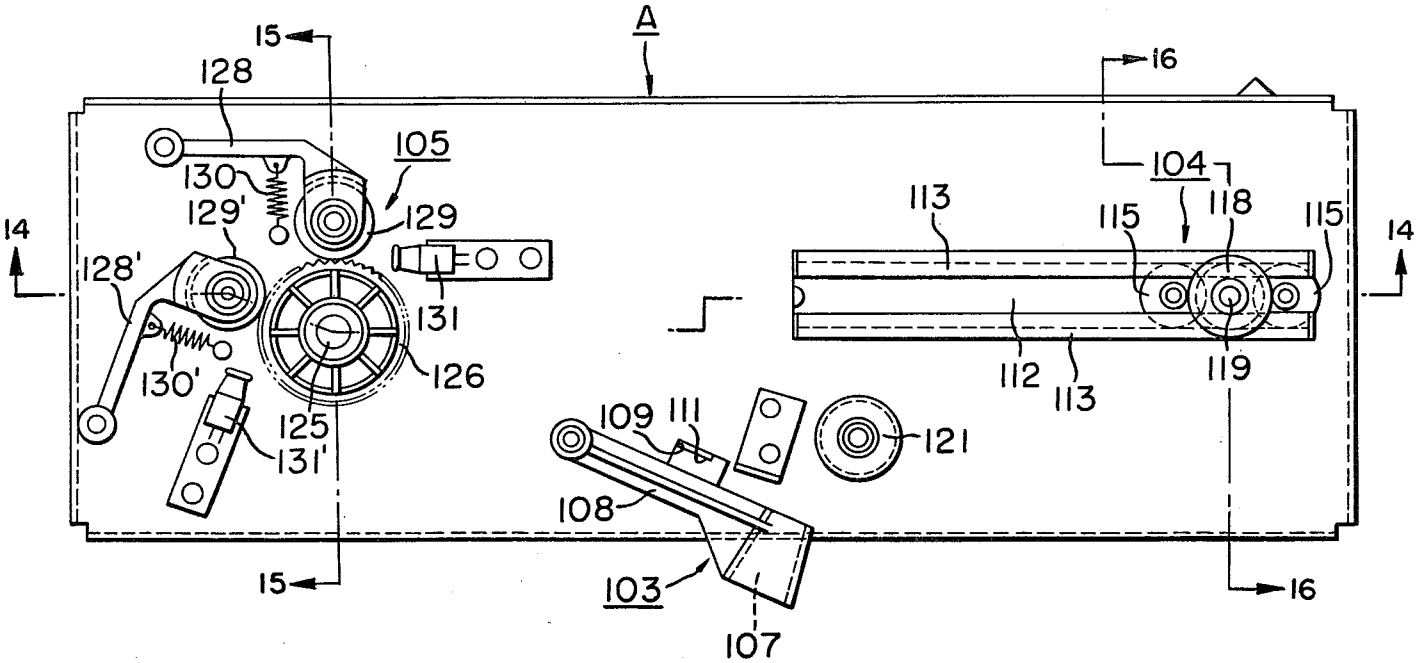
FIG. 12 is a front view of the actuating mechanism in a second embodiment of the present invention.
Figure 13:
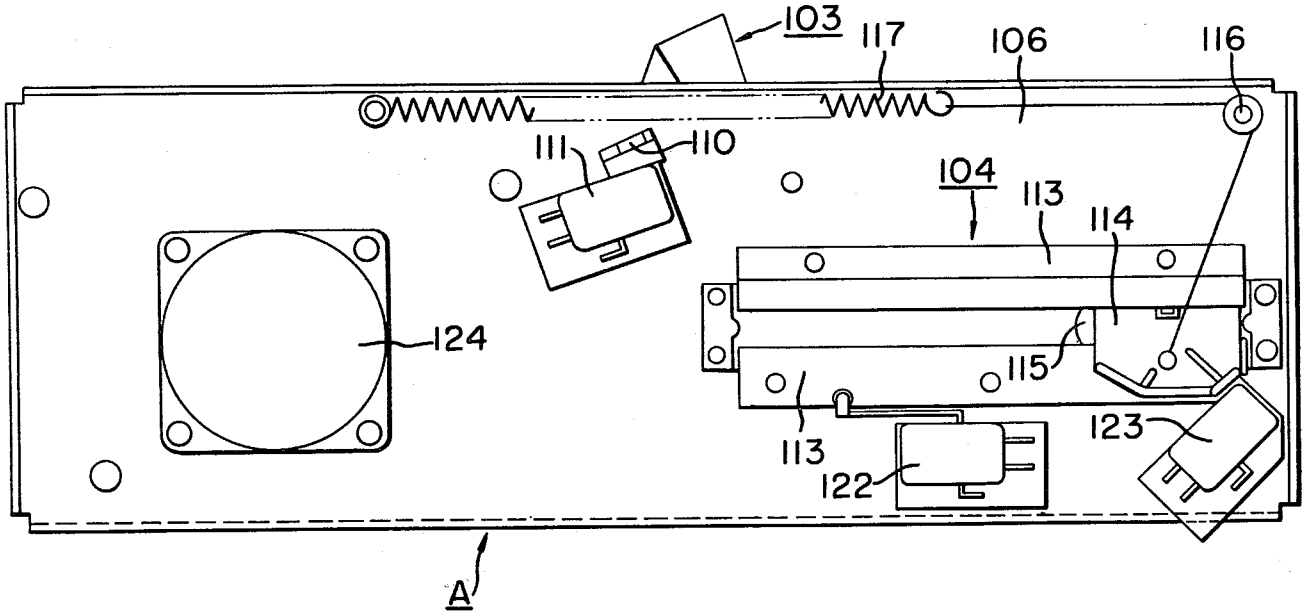
FIG. 13 is a rear view thereof (shown inverted).
Figure 14:
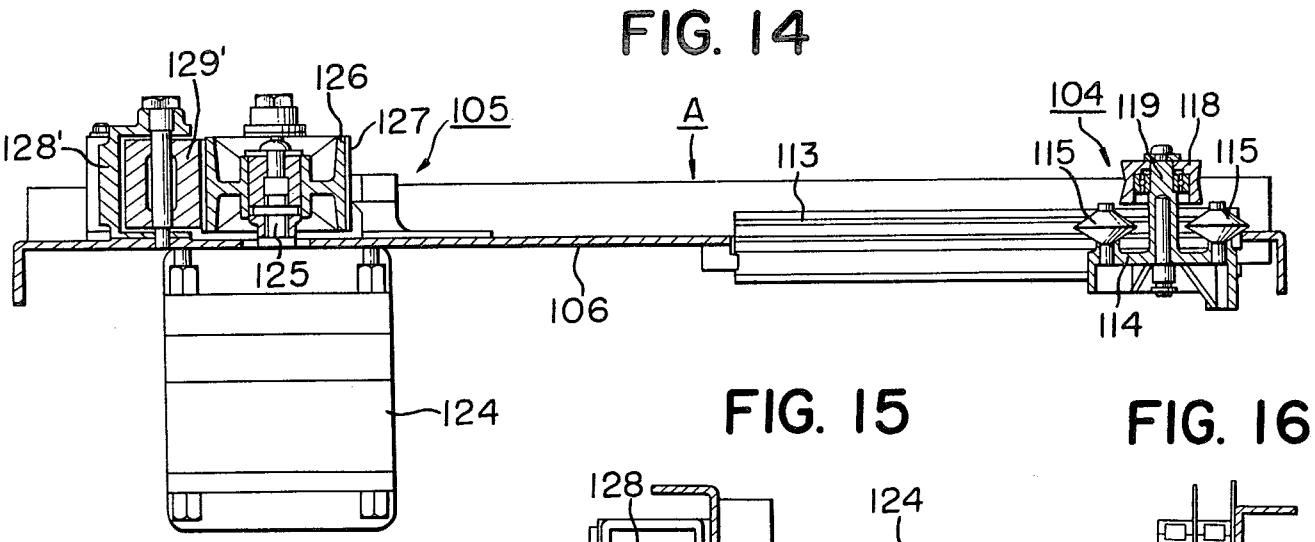
FIG. 14 is a cross-sectional view taken along line 14—14 in FIG. 12.
Figure 15:
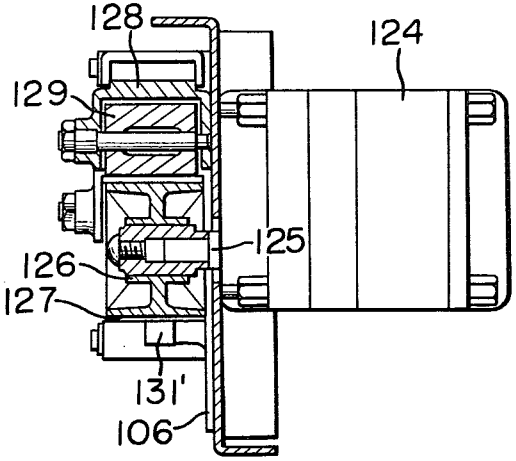
FIG. 15 is a cross-sectional view taken along line 15—15 in FIG. 12.
Figure 16:
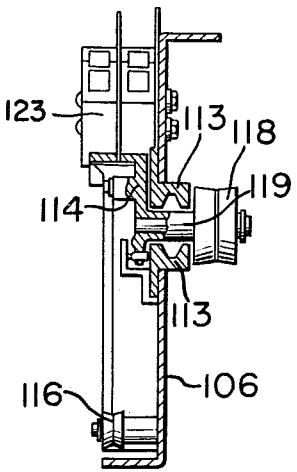
FIG. 16 is a vertical cross-sectional view taken along line 16—16 in FIG. 12.
Figure 17:
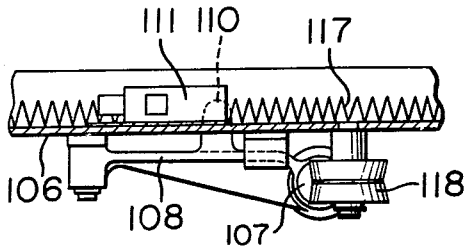
FIG. 17 is a fragmentary transverse cross-sectional view showing a gate and gate-actuated switch.

Operation of the present invention will now be discussed in conjunction with the circuit diagram of FIG. 11. In FIG. 11, the coils of relays are designated by capital letters of the alphabet and the contacts operated by such coils are designated by small letters corresponding to the capital letters. A plurality of contacts possessed by the same relay are distinguished from one another by hyphenated suffix numbers. Mechanical contacts of microswitches or the like are indicated by hollow circles so that they may be distinguished from the relay contacts which are represented as blackened circles.

When coins are thrown into the vending machine through an unshown slot thereof until a predetermined sum is reached, a contact 101 is changed over from the shown position momentarily to electrically energize a sale start relay ST and contacts st-1 through st-4 thereby operate (st-3 closing at its lower position) to render the entire machine ready to sell. Thereupon, the contact 101 is restored to its initial position but the relay ST is held by its enabled contact st-2.

When a switch 102 for designating the kind of the article to be bought is depressed, a relay S is electrically energized so that the contacts s-1 and s-3 thereof are closed (contact s-2 opening as holding contact s-1 closes). The motor Ms is rotated in a normal direction in response to the ground coming through the enabled make contacts st-3 and s-3, a released break contact sot-2, a break contact 213*a* of a microswitch 213 which is actuatable in response to a complete opening of the lid 4 of the storage chamber 2, and illustrative connection marks A. The ground also enables a relay RP via a diode D1. A closure of a make contact rp of the enabled relay RP energizes a solenoid 226, which releases a lock claw 223 for a ratchet wheel 221*a* which is fixed on the axis of the motor Ms opening the lid 4. This is done for the purpose of reducing noise which would generate due to the contact of the claw 223 with the ratchet wheel 221*a* when the wheel rotates.

When the motor Ms thus begins to revolve to open the lid 4, a microswitch 211 for determing the closure position of the lid 4 is closed. When the lid 4 gets to its full opening position, the microswitch 213 operates. The operation of the switch contact 213*a* transfers the ground coming through the contact st-3 to the motor 40, causing the lid control motor Ms to stop and the relay RP to be released. Since the contact st-4 involved within the slow release loop of the relay RP is still kept enabled during this operation, the relay RP will be released without delay. Therefore, the solenoid 226 is disabled by the thus released contact rp, permitting the claw 223 to fall into engagement with the ratchet wheel 221*a* with its weight or a spring force to prevent the wheel 221*a* from rotating in its opposite direction. The lid 4 is thus locked in its open state. Simultaneously, the motor M begins to revolve in its normal direction in response to the contact 213*a* turning to the enabling lead of the motor M. With such rotation of the motor, the yarn 7 connected to the articles 6 accommodated in the storage chamber 2 is drawn up by the yarn draw-up means 14 through the tension switch mechanism. When this occurs, the lid 4 of the storage chamber 2 has already been opened, as discussed in the above, to permit passage of an article 6. The article 6 having left the storage chamber 2 is lifted until it is blocked by the central bore 8*a* of the gate 8.

The support member 20 of the gate 8 is raised by the article 6 and pivoted counterclockwise in FIG. 1, thereby opening the first switch 26 and then changing over the second switch 27. The purpose of these two gate switches provided in this manner is to prevent any malfunction which would otherwise result from the chattering of the gate. Thereby, a gate relay SGT is electrically energized to close its contact sgt, thus rendering a relay SG ready to be electrically energized. The yarn 7 is still being drawn up so that the article 6 is detached from the yarn 7 by the gate 8. The detached article falls onto an inclined plate 70 disposed below the gate 8 and comes to rest on a discharge portion 71.

As soon as the article 6 is detached from the yarn, the gate 8 is lowered by its own gravity and the action of the spring 22, and the second switch 27 and then the first switch 26 are restored to their initial positions, but the relay SGT slowly releases with the aid of a resistor $R_1$ and capacitor $C_1$ so that the contact sgt maintains its closed position to electrically energize the relay SG. By the action of this relay SG, its contacts sg-1, sg-2 and sg-3 are opened. The relays S and ST therefore release.

Subsequently, after a predetermined time, discharge of the capacitor $C_1$ comes to an end, whereupon the relay SGT releases to open its contact sgt and further, the relay SG releases so that its contacts sg-1, sg-2 and sg-3 are restored to their initial positions.

During the above-described operation, namely, while the motor 40 is rotating in its normal direction to cause the yarn draw-up means to draw up the yarn, the pulley 54 of the guide means 15 is rotated in a normal direction by the motor 40 to downward transport the yarn which has been liberated from the yarn draw-up means 14 and nipped between the pulley and the pinch roller 57 of the guide means 16.

The vending machine may be constructed such that when the article 6 has been detached from the yarn 7 by the above-described operation, the machine is completely restored to its initial state and thus becomes ready for another sale, but if the machine is constructed such that the motor 40 is rotated in its reverse direction to return the yarn in the opposite direction, the interval between articles may be reduced. In the latter case, a path may be provided which leads from the break (upper) side of the contact st-3 through the break contact sg-3 and the third switch 34 to the reverse rotation terminal of the motor 40. The third switch 34 may be closed by the balancing means 28 as soon as the article begins to be lifted. Even after a first article lifted has been detached, if a subsequent article 6 is suspended from the yarn 7 to impart a tension thereto, the third switch 34 will remain closed and thus, by the restoration of the contacts st-3 and sg-3 to their initial positions, the motor 40 will be rotated in its reverse direction to return the yarn and thereby lower the suspended article. During such reverse rotation of the motor, transmission of the drive of the motor 40 to the pulley 54 of the guide means 15 is not permitted by the one-way clutch 55, 56 so that the pulley 54 and the pinch roller 57 are rotated by the yarn being drawn up in the reverse direction by the yarn draw-up means, thus permitting passage of the yarn.

By such action, the article 6 being suspended is lowered and placed on the stock of articles set at the bottom of the storage chamber 2, whereupon the tension of the yarn 7 is decreased so that the balancing means 28 is rotated clockwise in FIG. 2 by the force of gravity on the weight 30*a* to assume the position in which the said force of gravity and the tension of the yarn are balanced with each other. Thereupon, the third switch 34 is restored to its initial or open position to stop the reverse rotation of the motor.

The release of the third switch 34 causes the ground coming through the released break contact sg-3 to be transferred to the break contact of the switch 34 and transmitted via illustrative connection marks B and actuated contact 211*a* to the relay RP, which operates again in response. The contact 211*a* is still closed as the lid 4 is not in its close state now. A capacitor C3 is charged with the same ground through the released contact st-4 since the relay ST has already been released at this time. The diode D1 blocks this ground to prevent the motor Ms from being energized. The operation of the relay RP, which brings its contact rp close, gives rise to another energization of the solenoid 226 to remove the claw 223 from the ratchet wheel 221*a*. The lid 4 will return to its close state with its weight. When the lid 4 reaches its close position, the microswitch 211 is released to render its make contact 211*a* open, removing the ground that has energized the relay RP. The relay RP will be slow-released by discharging the capacitor C3 through a resistor R3. Upon the release of the relay RP, the opened make contact rp disables the solenoid 226 to permit the claw 223 to fall with its weight into engagement with teeth of the ratchet wheel 221*a*. In order not to lock the wheel 221*a* until the lid 4 has completely been shut, the slow release circuit of the relay RP was thus designed.

When the articles have been sold out with no subsequent article available for sale, the third switch 34 is restored to its initial position at the moment when the last article 6 has been detached from the yarn, and then the fourth switch 35 is actuated to turn on a sellout display lamp 103. By this, the sellout relay SOT is energized and its contacts sot-1, sot-2 ans sot-3 render the machine in non-vending condition. In a construction wherein the motor 40 is not reversed in rotation, the route leading from the break (lower) side of the contact sg-3 to the reverse rotation terminal of the motor 40 may be eliminated with the make terminal (not shown) of the contact sg-3 connected to the contact 211*a*. In such case, the third switch 34 is unnecessary.

Description will now be made of the procedures for replenishing the machine with articles and resetting the sellout condition.

Even after the machine is replenished with articles, it is often the case that the balancing mechanism 10 is fully rotated clockwise as viewed in FIG. 2 to thereby continue to operate the fourth switch 35. Therefore, when a non-lock button 104*a* for set-to-sale is depressed, a set-to-sale relay SET is energized because the contact sot-3 is closed, and the relay self-holds with the aid of its contact set-1. The motor 40 is energized by the route passing through the contacts set-1 and sot-2 (lower position), so that the motor is rotated in normal direction to start drawing up the yarn 7. When the yarn is sufficiently drawn up to become tensioned, the balancing mechanism 10 is rotated counter-clockwise as viewed in FIG. 1, thereby opening the fourth switch 35. Thus, there is no operating circuit formed for the relay SOT and therefore, the relay SOT is caused to slowly release by a time constant circuit determined by a capacitor $C_2$ and a resistor $R_2$. When the relay SOT has completely released, the contact sot-2 thereof returns to its upper position as shown in FIG. 11, thereby stopping the normal rotation of the motor 40. This completes the preparation for sale. The delayed releasing circuit for the relay SOT is sufficient if it can provide a retardation time long enough to ensure the safety with which the fourth switch 35 may be fully restored its initial position, and in the present embodiment, such time is of the order of 0.5 second, for example.

Reference will now be had to FIGS. 12 through 17 to describe a second embodiment of the present invention.

An actuating mechanism A is provided on a support plate 106, and a gate 103 is situated in the lower portion of the support plate 106 substantially at the center thereof and has one end pivotally supported to the support plate 106 and the other end provided with an arm 108 formed with a bore 107 for blocking passage of the article 6 and for detaching the article from the yarn 7. The arm 108 is provided with a projection 110 (FIG. 17) turned back through a hole 109 formed in the support plate 106, so that the projection 110 may actuate a first switch 111 which is operable by the gate and is attached to the back surface of the support plate.

A tension mechanism 104 is situated toward one side of the support plate 106 and has an elongated groove 112 formed lengthwise thereof. In the elongated groove 112, there are disposed guide rails 113 between which rollers 115, 115 provided to a movable member 114 are fitted so that the movable member 114 is movable rectilinearly along the guide rails 113. The movable member 114 is biased rightwardly in FIGS. 12 and 13 by a spring 117 through a guide 116 and in addition, a shaft 119 having a guide wheel 118 mounted thereon is overhung on the movable member 114 toward the front thereof so that the yarn passed through the bore 107 of the gate 103 and directed by the guide wheel 121 may be guided toward yarn draw-up means 105. In the path of movement on that side which is opposite from the movable member 114, namely, on that side adjacent to the yarn draw-up means, there is provided a second switch 122 and a third switch 123 for sellout display is provided at the opposite end.

The yarn draw-up means 105 includes a reversible motor 124 mounted on the back surface of the support plate 106, the rotary shaft 125 of the motor 124 being overhung toward the front and having a rotatable wheel 126 mounted thereon. The rotatable wheel 126 has anti-slip ridges 127 formed on the outer periphery thereof. Opposed to the rotatable wheel 126 are arms 128, 128' each having one end pivotally supported on the support plate 106 and having the other end pivotally supporting a press wheel 129, 129'. Springs 130 and 130' act on the arms 128 and 128' to urge the press wheels 129 and 129' against the peripheral surface of the rotatable wheel 126. Yarn directing members 131 and 131' are disposed on the yarn supply side and the yarn discharge side of the rotatable wheel 126, respectively.

In order that an article 6 pre-tied to the yarn 7 may be withdrawn from the storage member 2, the yarn 7 is directed by the guide wheel 121 and the guide wheel 118 of the movable member 114 through the bore 107 of the gate 103 and passed over the directing member 131, whereafter the yarn is urged by the rotatable wheel 126 and the press wheels 129, 129' so that the end thereof is passed through the directing member 131'. When the yarn 7 is drawn by the rotatable wheel 126 and the press wheels 129, 129' upon normal rotation of the motor, the movable member 114 is moved by the guide 118 against the force of the spring 117 of the tension mechanism 104 to thereby draw the yarn 7 until the article is blocked by the gate 103, and the article is detached from the yarn when a predetermined or higher tension is exerted on the yarn. After the detachment is completed, the motor is rotated in reverse direction to lower a subsequent article if it is in suspension, and the motor is stopped when the tension resulting from the suspended article becomes null.

In the circuit arrangement of the second embodiment, the first switch 111 corresponds to the switch 27 shown in FIG. 11, the second switch 122 to the switch 34, the third switch 123 to the switch 35, and the motor 123 to the motor 40 in the first embodiment. The circuit of the second embodiment is similar to the circuit of FIG. 11 with the exception that the switch 26 in the first embodiment is short-circuited and therefore, operation of the circuit of the second embodiment need not be described further.

While two embodiments of the present invention have been described with respect to a vending machine for a cold confection such as ice cream or the like or for frozen food, the vending machine of the present invention is not restricted thereto but is applicable to the vending of sandwiches, bread, snacks, candies and other food or any other articles than food which are connectible to an elongated member.

What I claim is:

1. A vending machine for selling articles by detaching articles which are connected to an elongated member at predetermined intervals, comprising:

draw-up means for drawing up said elongated member during vending;

gate means having therein an opening smaller in size than each of said articles, said gate means being effective to pass said elongated member into said draw-up means through said opening and to block passage of the leading one of said articles to detach said one article from said elongated member as it is drawn up by said draw-up means;

detector means for detecting the detachment of each of said articles from said elongated member by said gate means, and means responsive to said detector means for stopping the operation of said draw-up means.

2. A vending machine according to claim 1 further comprising:

an isolated refrigerating chamber for storing a plurality of articles to be sold, said chamber being formed with an opening through which said elongated member is drawn up;

means for normally closing said opening; and means for electrically actuating said closing means to open said opening while said elongated member is drawn up by said draw-up means.

3. A vending machine according to claim 2, wherein said actuating means includes a driving means for driving said closing means to open said opening and means responsive to said detector means for closing said opening.

4. A vending machine according to claim 3 further comprising means for holding said closing means at its opened position, said holding means terminating its holding operation in response to said detector means.

5. A vending machine according to claim 2 further comprising sealing means which is in tight contact with said closing means when the closing means closes said opening, whereby cooled air in the refrigerating chamber is prevented from leaking out.

6. A vending machine according to claim 2, wherein the side walls of said refrigerating chamber are distant from the side walls of the main housing of the vending machine, whereby heat by direct sun rays is prevented from transmitting to the refrigerating chamber.

7. A vending machine according to claim 1, wherein said gate means assumes a first position before and after the article detaching operation and a second position during the article detaching operation.

8. A vending machine according to claim 1, wherein said gate means is capable of assuming a first position before and after the article detaching operation and a second position during the article detaching operation, and said detector means detects the shift of said gate means from said second position to said first position to thereby detect the detachment of said article.

9. A vending machine according to claim 1, wherein said gate means has a ring-shaped article passage blocking portion which forms said opening.

10. A vending machine according to claim 9, wherein the cross-section of said article passage blocking portion has a uniform curvature in the surface thereof which contacts said one article.

11. A vending machine according to claim 1, further comprising:

balancing means capable of assuming a first position in response to tension on said elongated member due to drawing up of at least one of said articles connected to said elongated member and assuming a second position when said balancing means is liberated from said tension when said articles have been sold out.

12. A vending machine according to claim 11, further comprising a sellout display switch operated to display the sellout when said balancing means is in said second position.

13. A vending machine according to claim 11, wherein said balancing means has a pivotable member engaged with said elongated member and pivotable under the tension of said elongated member.

14. A vending machine according to claim 13, wherein said pivotable member is provided with a weight for pivoting said pivotable member in a direction to resist said tension.

15. A vending machine according to claim 11, wherein said balancing means has a movable member rectilinearly movable under the tension of said elongated member.

16. A vending machine according to claim 15, wherein said movable member is provided with bias means for biasing said movable member in a direction to resist said tension.

17. A vending machine according to claim 16, wherein said bias means is a pull spring.

18. A vending machine according to claim 1, further comprising:

a refrigerating chamber for storing articles to be sold which is connected to said elongated member, said refrigerating chamber being formed with an opening which is large enough to pass therethrough said articles and through which said elongated member is drawn up, and means for closing said opening when said detecting means detects the detachment of the leading one of said articles connected to said elongated member.

19. A vending machine according to claim 1, wherein said gate means is capable of assuming a first position before and after the article detaching operation and a second position during the article detaching operation; and said detector means includes a first switch moved to a first position in response to shifting of said gate means from its first position to its second position and restored to its original position in response to shifting of said gate means from its second position to its first position, and means for continuing to operate said drawup means until said first switch is restored to its original position.

20. A vending machine according to claim 19, wherein said detector means comprises a second switch moved to a first position when said gate means is shifted to its second position and restored to its original position when said gate means is shifted from its second position to its first position, said means for continuing to operate said draw-up means comprising a slow releasing relay energized when said second switch is in its first position and a relay energized by the slow releasing action of said slow releasing relay after said first and second switches are restored to their original positions.

21. A vending machine according to claim 1, further comprising:

balancing means including a first means over which said elongated member is trained and which tends to move in one direction in response to tension of said elongated member and including a second means for biasing said first means in a direction opposite to said one direction, said first means normally assuming a first position in which said tension is counterbalanced by the biasing force of said second means and moving in said first direction to a second position during drawing up of an article, when said tension is greater than the biasing force of said second means, switch means for detecting that said first means is in said second position, and means responsive to said switch means for operating said draw-up means in reverse after detachment of an article and until the tension on said elongated member is reduced to permit said first means to move in said opposite direction away from said second position.

22. A vending machine according to claim 21, wherein said first means is rectilinearly movable between said first position and said second position.

23. A vending machine according to claim 22, wherein said second means is a pull spring.

24. A vending machine according to claim 21, wherein said first means is arcuately movable between said first position and said second position.

25. A vending machine according to claim 24, wherein said second means is a weight.

26. A vending machine according to claim 25, wherein said weight is rigidly connected to said first means.

27. A vending machine according to claim 21, further comprising:

a refrigerating chamber for storing articles to be sold which are connected to said elongated member, said refrigerating chamber being formed with an opening which is large enough to pass therethrough said articles and through which said elongated member is drawn up, and means for closing said opening when the reverse operation of said draw-up means has been stopped.

28. A vending machine according to claim 1, wherein said draw-up means includes means for nipping said elongated member and means for rotating said nipping means to draw up said elongated member.

29. A vending machine according to claim 28, wherein said nipping means includes a rotatable wheel formed with anti-slip ridges on the outer periphery thereof, and at least one pinch roller means pressed against said outer periphery of said wheel to pinch said elongated member between said periphery of said rotatable wheel and said pinch roller means, whereby rotation of said rotatable wheel causes said elongated member to be drawn up.

30. A vending machine according to claim 28, further comprising:

means provided downstream of said draw-up means for imparting a tension to said elongated member to prevent said elongated member from being entangled in said draw-up means.

31. A vending machine according to claim 30, wherein said tension imparting means comprises a pair of guide means rotatable in engagement with each other to thereby guide said elongated member by nipping the elongated member at the position of said engagement.

32. A vending machine according to claim 31, wherein one of said pair of guide means includes a pulley rotatively driven at a speed equal to or slightly higher than the draw-up speed of said draw-up means, and the other of said pair of guide means is a rotatable pinch roller urged against said pulley.

33. A vending machine according to claim 32, wherein said one of said pair of guide means further includes a one-way clutch which rotates said pulley in a direction to draw out said elongated member but inhibits said pulley from being rotated by said clutch in a direction to draw back said elongated member.

34. A vending machine according to claim 33, wherein said one-way clutch comprises a ratchet wheel mounted on the drive shaft of said pulley and a brake mounted on said pulley and meshing with said ratchet wheel.

35. A vending machine according to claim 32, wherein the peripheral guide surface of said pulley is concavely contoured and the peripheral surface of said pinch roller is convexly contoured to fit the concavely contoured guide surface of said pulley.

36. A vending machine according to claim 31, wherein said guide means are driven by the drive motor for said draw-up means.

37. A vending machine for selling articles by detaching articles which are connected to an elongated member at predetermined intervals, comprising;

draw-up means for drawing up said elongated member during vending, gate means effective to block passage of the leading one of said articles and to detach said one article from said elongated member as it is drawn up by said draw-up means;

detector means for detecting the detachment of each of said articles from said elongated member by said gate means, and means responsive to said detector means for stopping the draw-up operation of said draw-up means.

38. A vending machine according to claim 37, wherein said gate means includes a movable member which is capable assuming a first position before and after the article detaching operation and a second position during the article detaching operation, and said detector means detects the shift of said movable member from said second position to said first position to thereby detect the detachment of said article.

39. A vending machine according to claim 38, wherein said movable member is formed with an opening which is smaller in size than each of said articles and through which said elongated member is passed.

40. A vending machine for selling articles by detaching articles which are connected to an elongated member at predetermined intervals, comprising draw-up means for drawing up said elongated member during vending, said draw-up means comprising means for nipping said elongated member and including a plurality of nipping members each having a nipping surface; means for rotating said nipping members, said rotating means including a pair of discs opposed to each other and rotatably driven about a common shaft, said nipping members being mounted on said discs along a common circumference of the discs and being axially slidable so that said nipping surface of one of said nipping members mounted on one of said discs may be opposed to the nipping surface of one of said nipping members mounted on the other of said discs; and a pair of cam plates provided axially outwardly of said discs, the cam plates including respective flat portions opposed to each other which urge the opposed nipping members to contact each other and nip said elongated member therebetween, and the cam plates further including respective axially outwardly inclined portions opposed to each other which cause the opposed nipping members to move apart, so that said elongated member is easily nipped or liberated, whereby rotation of said discs causes said elongated member to be nipped and drawn up by said nipping members.

41. A vending machine according to claim 40, wherein each of said nipping members is axially outwardly urged and includes an embedded ball which can make rolling contact with said flat and inclined portions of said cam.

42. A vending machine according to claim 40, wherein said nipping surface of each said nipping members is formed with grooves for increasing nipping function.

43. A vending machine for selling articles by detaching articles which are connected to an elongated member at predetermined intervals, comprising:

draw-up means for drawing up said elongated member during vending;

gate means for detaching one of said articles from said elongated member as it is drawn up;

means provided downstream of said draw-up means for imparting a tension to said elongated member to prevent said elongated member from being entangled in said draw-up means;

said tension imparting means including a pair of guide means rotatable in engagement with each other to thereby guide said elongated member by nipping the elongated member at the position of said engagement;

one of said pair of guide means including a pulley rotatively driven at a speed equal to or slightly higher than the draw-up speed of said draw-up means, and the other of said pair of guide means including a rotatable pinch roller urged against said pulley; and means for preventing said elongated member from being entangled in said pulley, said preventing means including a fixed member which substantially contacts the peripheral guide surface of said pulley.

44. A vending machine for selling articles by detaching articles which are connected to an elongated member at predetermined intervals, comprising:

draw-up means for drawing up said elongated member during vending;

gate means for detaching one of said articles from said elongated member as it is drawn up;

means provided downstream of said draw-up means for imparting a tension to said elongated member to prevent said elongated member from being entangled in said draw-up means;

said tension imparting means including appair of guide means rotatable in engagement with each other to thereby guide said elongated member by nipping the elongated member at the position of said engagement;

one of said pair of guide means including a pulley rotatively driven at a speed equal to or slightly higher than the draw-up speed of said draw-up means, and the other of said pair of guide means including a rotatable pinch roller urged against said pulley; and means for preventing said elongated member from being entangled in said pinch roller, said preventing means including a fixed member which substantially contacts the peripheral surface of said pinch roller.

45. A vending machine for selling articles by detaching articles which are connected to an elongated member at predetermined intervals comprising:

an isolated refrigerating chamber for storing a plurality of articles to be sold, said chamber being formed with an opening in an upper side portion thereof through which said elongated member is drawn up;

means for normally closing said opening by its own weight;

a driving mechanism provided completely above said refrigerating chamber including draw-up means for drawing up said elongated member through said opening and detaching means for detaching the leading one of said articles from said elongated member;

means for electrically actuating said closing means to open said opening and means for holding said closing means in its opened position while said elongated member is drawn up;

detector means for detecting the detachment of the leading one of said articles, said detector means being actuated by a mechanism having a first position before and after detachment of said article, and a second position during the detaching operation, the mechanism being moved to the second position by the article as the elongated member is drawn up, and returned to its first position by its own weight upon detachment of the article;

means responsive to said detector means for releasing said holding means to allow the closing means to move to its closed position; and means for damping the closing movement of said closing means.

* * * * *